US005173063A

United States Patent [19]

Barkus et al.

[11] Patent Number: 5,173,063

[45] Date of Patent: Dec. 22, 1992

[54] RECEPTACLE CONNECTOR HAVING PROTECTED POWER CONTACTS

[75] Inventors: Lee A. Barkus, Millersburg; David B. Sinisi; Matthew M. Sucheski, both of Harrisburg, all of Pa.

[73] Assignee: AMP Incorporated, Harrisburg, Pa.

[21] Appl. No.: 824,767

[22] Filed: Jan. 17, 1992

Related U.S. Application Data

[63] Continuation of Ser. No. 670,505, Mar. 15, 1991, abandoned, which is a continuation-in-part of Ser. No. 481,253, Feb. 20, 1990, abandoned.

[51] Int. Cl.[5] ..... H01R 13/64

[52] U.S. Cl. ..... 439/681; 439/633

[58] Field of Search ..... 439/677-681, 439/660, 692, 374, 380, 381

[56] References Cited

U.S. PATENT DOCUMENTS 3,576,519 4/1971 Janye et al. ..... 459/681
3,818,420 6/1974 Barr ..... 439/680
4,224,486 9/1980 Zimmerman, Jr. ..... 439/681
4,726,791 2/1988 Rudy, Jr. et al. ..... 439/677
4,818,237 4/1989 Weber ..... 439/677
4,884,975 12/1989 Pelzl et al. ..... 439/681

*Primary Examiner*—David L. Pirlot

[57] ABSTRACT

An electrical connector includes a dielectric housing including a transverse body section and a shroud portion extending forwardly therefrom and defining a cavity, an array of pin contact members extending forwardly of the body section and within the cavity and at least one pair of closely spaced elongate members within the cavity. The elongate members extend to respective leading ends forwardly beyond the leading edge of the shroud portion and cooperate with the shroud portion and with each other to disallow inadvertent entry of a human finger into the cavity proximate pin contacts adjacent the elongate members. The pair of elongate members further provide aligning and keying means for the connector.

15 Claims, 5 Drawing Sheets

RECEPTACLE CONNECTOR HAVING PROTECTED POWER CONTACTS

This application is a continuation of application Ser. No. 07/670,505 filed Mar. 15, 1991, now abandoned, in turn, a continuation in part of application Ser. No. 07/481,253 filed Feb. 20, 1990, abandoned.

FIELD OF THE INVENTION

This invention relates to the field of electrical connectors and more particularly to connectors having arrays of power contacts.

BACKGROUND OF THE INVENTION

In today's electronic equipment, electrical interconnection is often provided by a plurality of rows of connectors mounted to a backplane or mother board interconnected to respective corresponding mating electrical connectors mounted to a plurality of daughter cards. Generally the connectors extend along the full length of the daughter card and include a highly dense array of contact members. In bringing such connectors into mating engagement it is necessary that the corresponding terminals engage and mate in associated pairs. Typically the daughter cards are mounted in card guides to aid in proper alignment of the connectors. For high density connectors having many small contact members, however, precise alignment requires more than just the card guide and frame members. The connectors, therefore, must also be provided with aligning means that complete the alignment prior to mating engagement of the terminal members. Furthermore, it is also desirable that keying means be provided to allow mating of connectors intended to be mated and disallowing mating of connectors not intended to mate.

In interconnecting the mother board or backplane to the daughter boards, it is often necessary to transmit both power as well as signal lines between the boards. Typically this has been accomplished by having one or more power connector units and one or more signal connector units positioned along the mating interface. In order to meet the demands of the industry to minimize the size of electronic equipment and provide for a maximum number of electrical interconnections, it is desirable to provide highly dense connectors that require a minimum amount of space on the respective boards.

It is further desirable to provide an array of modular connector units whereby the location of the power and signal lines can be readily located at the desired intervals position in each connector array by inserting the appropriate module.

Owing to the current being carried by the power portion of the interconnecting systems, certain safety requirements must also be met to prevent accidental touching of the power contacts by a human finger. In one commercially used safety test, a blunt ended probe having a diameter not less than 0.25 inches is used to test the safety of the contact array. To pass the test, the probe must be prevented from engaging any power contacts of the array.

Furthermore, it is also desirable to include means for aligning the corresponding connectors prior to engagement of the complementary contact members therein, to prevent damage to the corresponding mating power or signal contact members.

It is further desirable to have means for keying the corresponding mother board and daughter board connectors to assure accurate interconnection of the desired power and signal lines.

While it is known to provide aligning and keying features for electrical connectors, typically these features are added at the ends of the mating connectors thereby requiring additional space in the array of ganged connector modules. U.S. Pat. No. 4,726,791 discloses one such keying system for connectors comprising hexagonally shaped key members disposed in key-receiving passageways adjacent the ends of the contact arrays in the plug and receptacle sections of the connector. U.S. patent Ser. No. 07/252,220 discloses another type of aligning and keying system for mounting connectors in a framework having both axial and angular centers. The connector is used to interconnect a mother board to a daughter board. Alignment pins and key members are located along the exterior edges of the connector housing and intermediate adjacent connectors in a row of connectors.

It is desirable to provide for keying or polarization of the plurality of ganged connectors while minimizing the space required on a board.

SUMMARY OF THE INVENTION

Accordingly, the present invention is directed to an electrical connector that alleviates the disadvantages and deficiencies of the prior art by providing guard means for preventing accidental touching of power contacts within the connector that concomitantly provides aligning means for corresponding connectors, while minimizing the space required on a backplane, circuit board or the like.

In accordance with the present invention an electrical receptacle for use in mating connectors mounted on circuit boards and the like, comprises a dielectric housing including a transverse body section and a shroud portion extending forwardly therefrom to a leading edge and further has an array of pin contact members extending forwardly of the body section and within a cavity defined by the shroud portion and at least one pair of elongate members extending forwardly beyond the leading edge of the shroud portion, the elongate members cooperating with the shroud portion to disallow inadvertent entry of a finger or the like to engage the contact members proximate the elongated members. The array of pin contact members extend forwardly of the body section and are within the shroud portion such that the leading ends of the pin contact members are recessed inwardly of the leading edge of the shroud portion. The pair of closely spaced elongate members are disposed within the shroud portion and within the pin contact array. The leading ends of the elongate members extend beyond the shroud portion and therefore the leading ends of the pin contact members. The elongate members are judiciously placed so as to prevent entry and contact of the pin contact members by any portion of a normally sized human finger. The elongate members therefore minimize hazards resulting from accidental contact with the pin contacts that are adjacent to the elongate members.

For purposes of illustrating the invention the pair of elongate members are shown disposed within a four by six array of power contact members. It is to be understood that the invention may be used in other arrangements of contact member arrays. The number of elongate members used in other contact arrays will be determined by the number of power or other contact members that need to be protected. Additionally elongate members may be used in the may be used, if desired, within the array of signal contact members. Since the elongate members extend beyond the shroud they will engage the mating face of the corresponding mating connector before the power and signal contacts members and therefore guide the mating connectors together.

In addition, at least one of the elongate members may include keying portions that will cooperate with a complementary keying aperture on the mating plug connector to assure the desired connectors are mated.

It is an object of the invention to provide a means for aligning corresponding mating connectors without extending the external dimensions or size of the connector.

It is also an object of the invention to provide a connector having a minimum number of parts by providing parts that will serve multiple functions in the connector.

It is another object of the invention to provide guard means for preventing accidental engagement with the contact members of an array.

It is a further object of the invention to provide a modular power contact connector having safety and aligning features that permit use of the module at one or more locations along an extended connector array.

Some of the objects and advantages of the invention having been stated, others will appear as the description proceeds when taken in conjunction with the accompanying drawings.

DETAILED DESCRIPTION OF THE DRAWING

Figure 1:
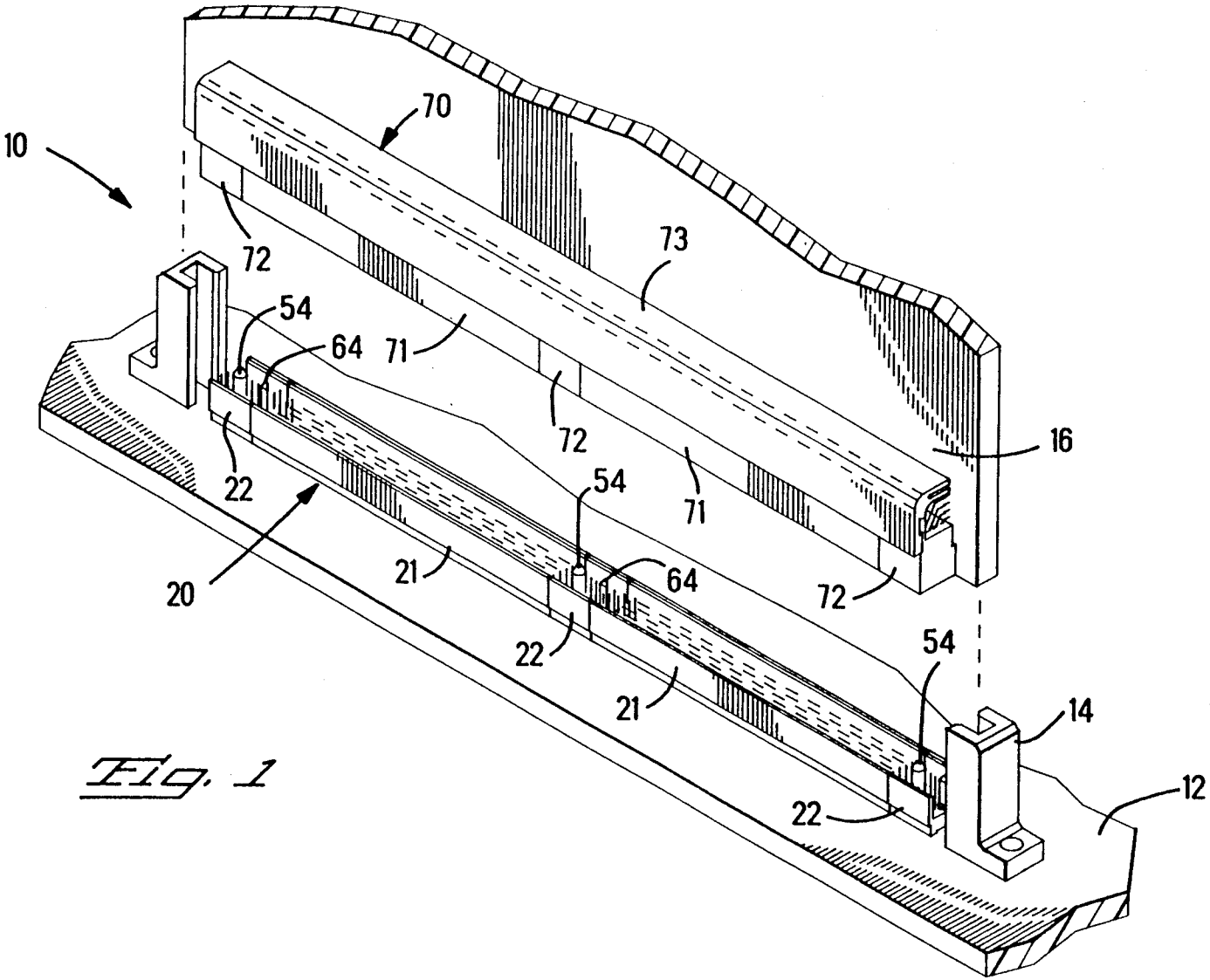
FIG. 1 is a three dimensional exploded view of an electrical connector assembly made in accordance with the invention, showing the receptacle connector mounted to a backplane and a mating plug connector on a daughter board exploded therefrom.

FIG. 1 is an exploded three dimensional of a modular connector assembly 10 made in accordance with the invention mounted to and electrically interconnecting circuits between a backplane 12 and a daughter card 16, the daughter card 16 being adapted to be received in a frame mounted to the backplane or mother board 12, shown representatively as card guide 14. As illustrated in this Figure, a pin header receptacle member 20 is mounted to backplane 12 and comprises a plurality of signal modules 21 and power modules 22. The mating plug connector member 70 is mounted to daughter card 16 and comprises a plurality of complementary signal modules 71 and power modules 72. FIG. 1 also shows stiffener member 73 extending along the back of plug connector 70. The stiffener is preferably of the type disclosed in U.S. patent application Ser. No. 07/380,067.

Figure 2:
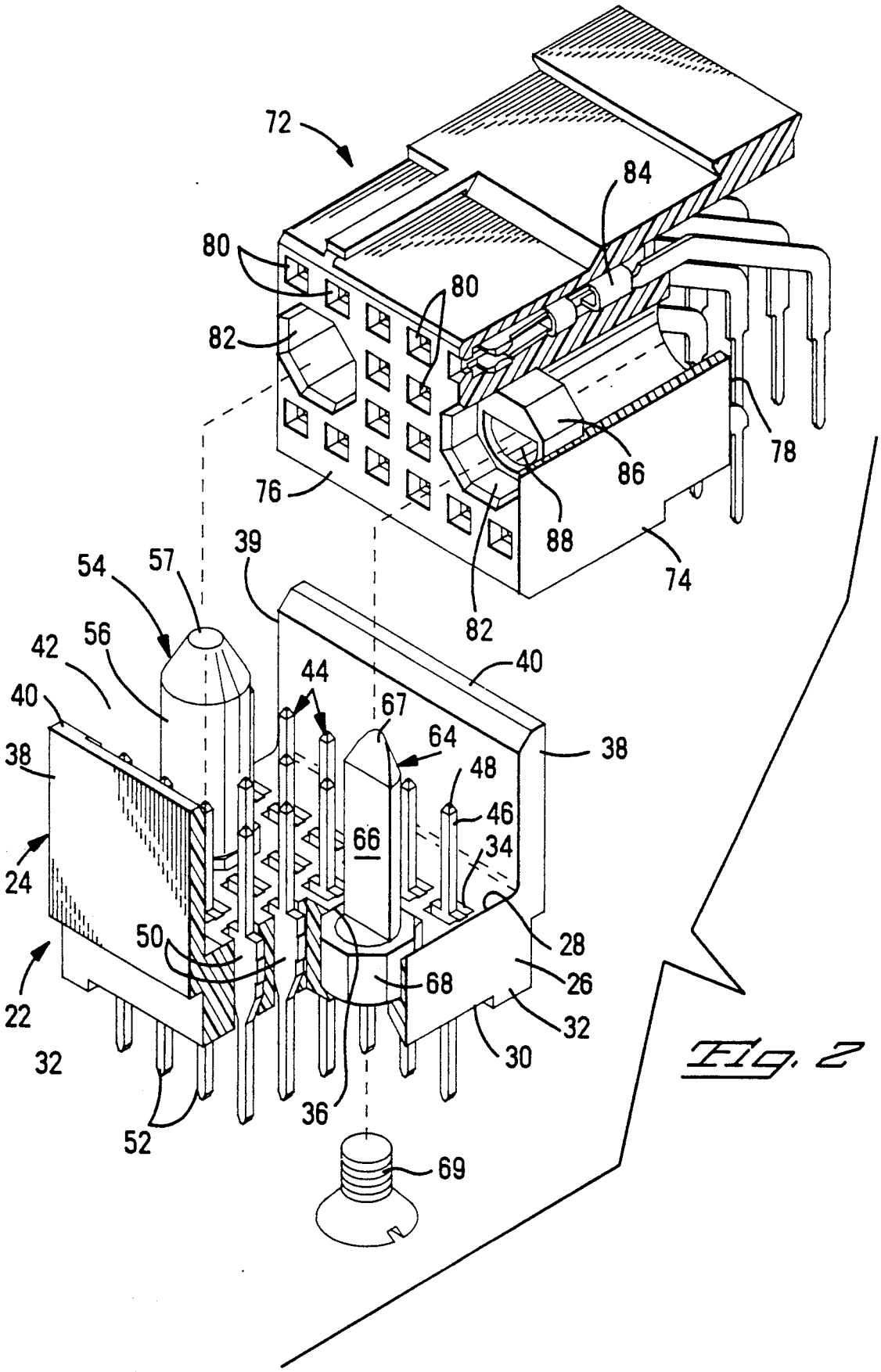
FIG. 2 is an exploded sectioned perspective view of the pin header receptacle and the mating plug member of one of the power modules of the connector assembly of FIG. 1 with portions of the housings broken away to illustrate the structure of the keying feature.
Figure 3:
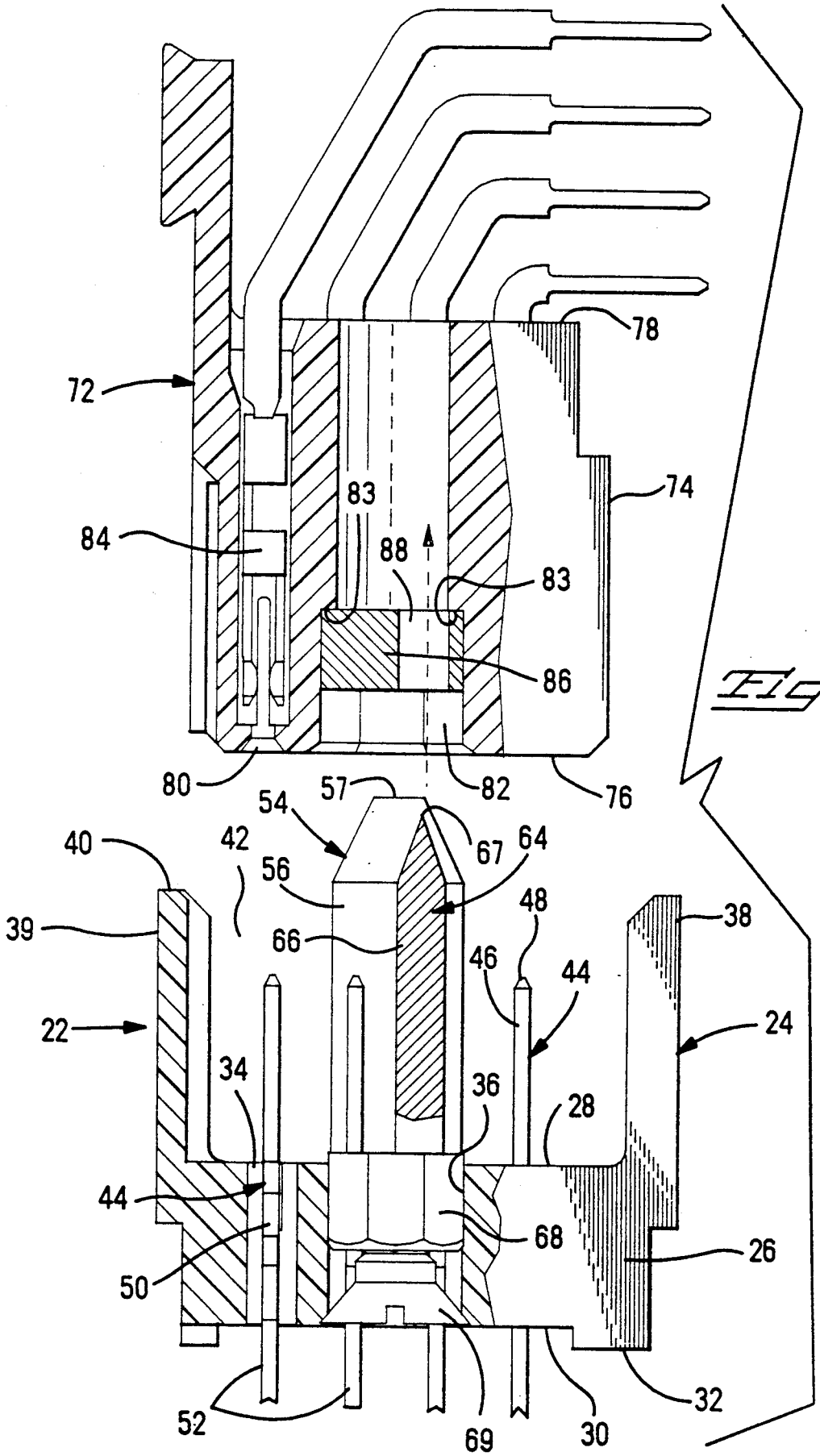
FIG. 3 is an orthogonal sectioned view of the mating connector of FIG. 2.
Figure 7:
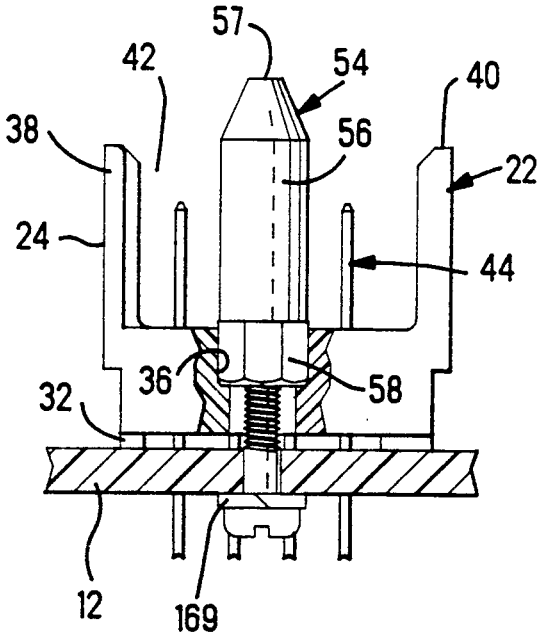
FIG. 7 is a partially sectioned view of the receptacle module illustrating a means for attaching an elongate member to the housing and concomitantly securing the module to the backplane.

Referring now to FIGS. 2 and 3, power module 22 comprises a housing 24 having a transverse body section or base 26 including an inner or mating face 28, an outer or board mounting face 30 and standoff portions 32 extending downwardly from board mounting face 30. Body section 26 also includes a plurality of first apertures 34 extending from inner face 28 to outer face 30 and defining terminal receiving passageways and a plurality of second apertures 36 extending between inner and outer faces 28, 30 respectively and defining passageways for receiving elongate members 54, 64 therein as more fully described below. Housing 24 further includes side walls 38 extending upwardly from transverse body section 26 defining a shroud portion 39 having a leading edge 40. Shroud portion 39 and body section 26 define a cavity 42 therebetween. A plurality of terminal members 44 are disposed in the first apertures 34, the terminal members 44 including a first mating portion 46, intermediate portion 50, and a second mating portion or board receiving portion 52. As shown in FIGS. 2 and 3 the leading ends 48 of mating portions 46 are recessed within the cavity 42 such that the leading edges 40 of the shroud 39 extend outwardly from the leading ends 48 of the terminal members 44. The intermediate portions 50 of the respective terminal members 44 are configured to be received within the terminal receiving passageways 34 of housing 24 and are shown representatively as being secured by an interference fit. The second mating or board engaging portion 52 of the terminal members 44 are shown representatively as pin members for being soldered or otherwise retained within the corresponding apertures (not shown) of the backplane 12. It is to be understood that other configurations of the second mating board mounting portion 52, such as compliant pin members may also be used to secure connector module 22 to the mother board, one such example is shown in FIG. 7. It is further to be understood that the array of contact members may also include contact members having longer first mating portions such as members 45, shown in FIG. 9.

FIGS. 2 and 3 also show a pair of elongate members comprised in the preferred embodiment of first or alignment member 54 and a second or keying member 64. In FIG. 3, keying member 64 is shown in section in the foreground and alignment member 54 is shown in the background. First and second elongate members 54, 64 include first body portions 56, 66 respectively and second or mounting portions 58, 68 respectively. First body portion 56 of aligning member 54 is an essentially round or polygonal member having leading end 57. First body portion 66 of keying member 64 is essentially half of a polygonal member as known in the art. For purposes of illustration, member 64 is shown as a hexagon. The leading ends 57, 67 of aligning and keying members 54,64 are configured to be received in a complementary configured aligning and keying apertures 82,88 respectively of the corresponding mating plug module 72. In the preferred embodiment, the leading end 57 of the first member or aligning member 54 extends above the leading end 67 of the keying member 64 so that the connector assembly 10 can be properly aligned before the keying member 64 is engaged. The alignment members are sufficiently long enough to effect axial alignment of the connectors prior to mating engagement of the contact terminals.

In accordance with the invention, the base portions 58, 68 of elongate members 54, 64 are identical, the structure, therefore, will be discussed with reference to base portion 68 of keying member 64. As shown in FIGS. 2 and 3, the base portion 68 is shaped as a regular polygonal portion, which is dimensioned to be received and held in a complementary polygonal portion of a respective aperture 36 in housing 24. As best seen in FIG. 2, a screw 69 is inserted from the underside 30 of the pin header module 22 to secure the elongate member 64 in position. For purposes of illustration the base portion 68 is shaped as a hexagon. Other configurations may also be used. A regular polygon is preferred to prevent rotation of the alignment or keying member or both. In accordance with the invention second apertures 36 of base or transverse portion 26 are identical such that elongate members 54, 64 may be secured in either aperture 36. To maximize the possibilities for aligning and keying, the elongate members may include two post members represented as 54 or two keying members 64 or a combination thereof. The interchangeability and resulting permutations and combinations of elongate members 54, 64 allow the pin header module 22, and therefore, assembly 20 to be customized at the time of assembling the connector array in an apparatus, thereby minimizing the problem of having duplicate keying arrangements for connectors 20 in the same connector on a motherboard or backplane.

FIGS. 2 and 3 further show the plug power module 72 comprising a housing 74 having mating face 76, rear face 78 and a plurality of first and second apertures 80, 82 therethrough. Apertures 80 define and receive socket members 84 therein. Apertures 82 are configured to receive corresponding first and second body portions 56,66;58,68 elongate members 54, 64 respectively of corresponding receptacle power module 22 upon mating therewith. FIG. 2, the passageways 82 of plug modules 72 are identically configured such that a keying nut 86 can be received within the passageway 82 in a selected position to receive keying post 64. Keying nut 86 includes aperture 88 extending therethrough and configured to receive first body portion 66 of keying post 64. Passageways 82 have a forward polygonal shaped portion and a smaller rearward cylindrical portion with ledge 83 being formed at the transition location between the two portions. As best seen in FIG. 3, the keying nut 86 is securable, preferably by press fit, against ledge 83 within passageway 82. Keying nut 86 can be removed from passageway 82 by inserting a tool from rear face 78 of housing 74 into aperture 82. Again this versatility for locating alignment and keying members 54, 64 provides a means whereby the connector assembly can be customized at the time an apparatus is being made.

Figure 4:
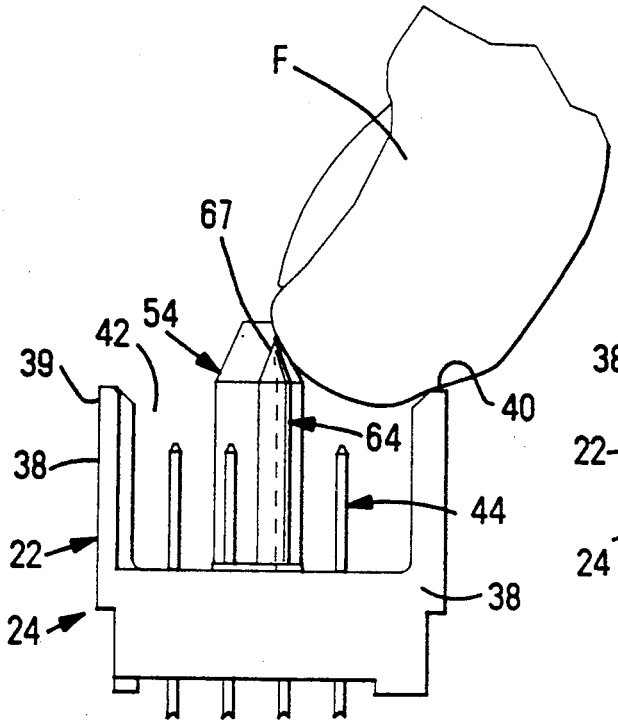
FIGS. 4 and 5 are end views of the receptacle member illustrating the guard means and safety features of the connector of FIG. 2.
Figure 5:
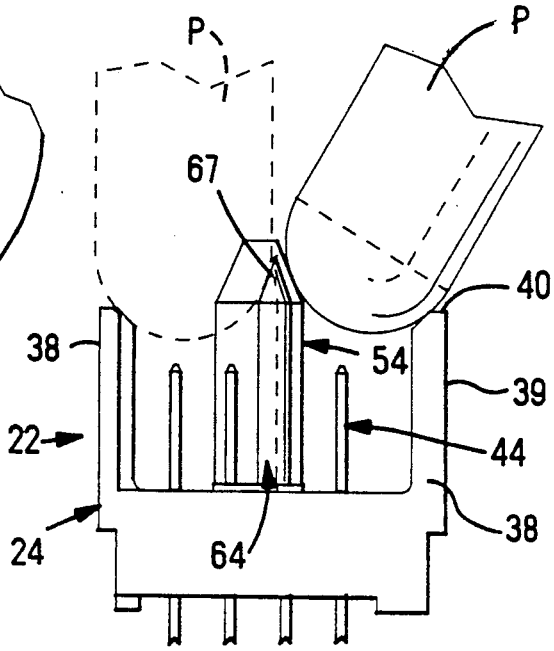
Figure 6:
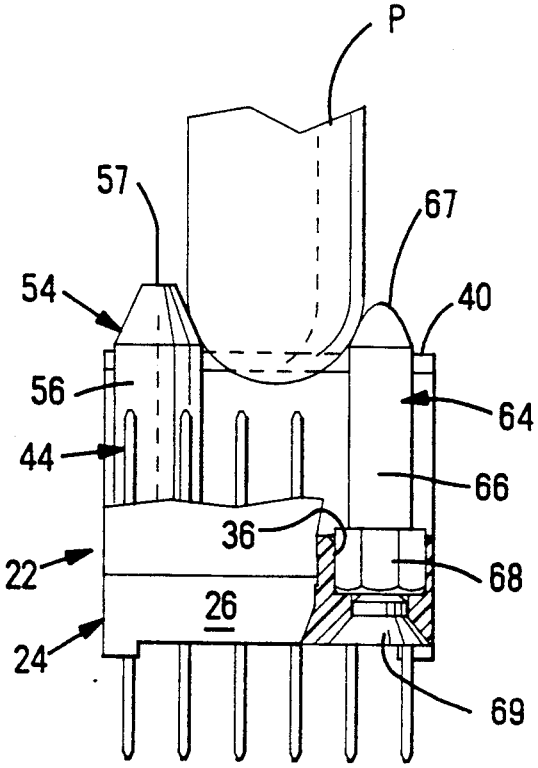
FIG. 6 is a partially sectioned view of the receptacle member with portions of the housing broken away illustrating the guard means of the connector of FIG. 2.

FIGS. 4 and 5 are taken from the same direction as FIG. 3 and illustrate the safety features of the present invention wherein by the judicious placing of the elongate members 54, 64, neither a finger (FIG. 4) nor a probe having a minimum diameter of 0.25 inches (FIG. 5) can be inserted between an elongate member 64 and a side wall 38 of receptacle module 22 to engage the recessed pin contact members 44 adjacent members 54 and 64. FIG. 6 is taken looking along a side wall of module 22 and illustrates that the probe cannot be inserted between the pair of elongate members 54,64 to engage adjacent pin members 44.

FIG. 7 shows a further feature of the invention wherein at least one of the elongated members, shown here as aligning member or post 54, can be used to provide means for securing the connector to board 12. In this arrangement, board 12 includes an aperture 11 for receiving mounting means 169 from the under surface of panel or board 12. It is to be understood that the elongated member may also be provided with other mounting means such as jackscrews.

Figure 8:
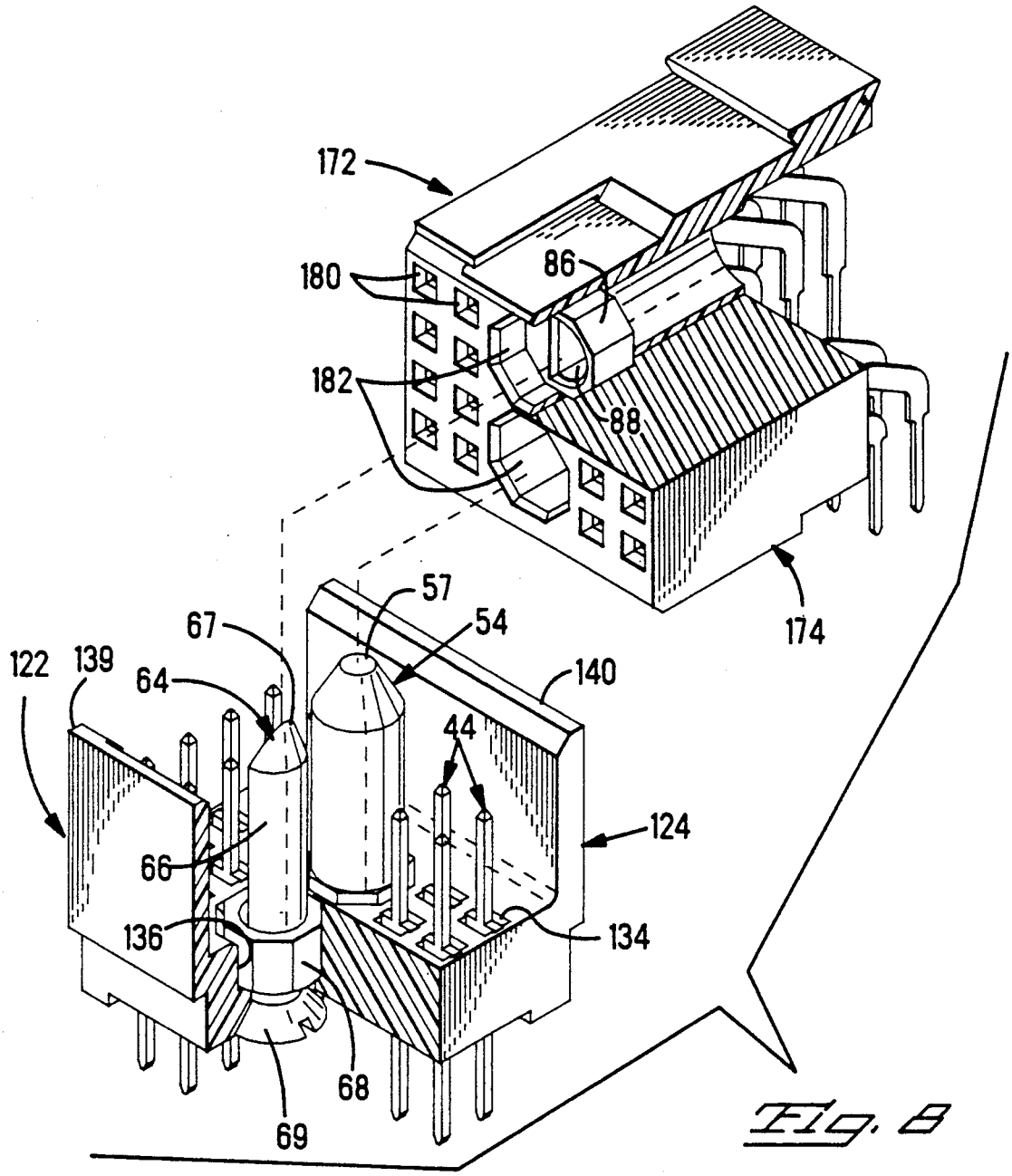
FIG. 8 illustrates an alternative embodiment of the connector of FIG. 2.

FIG. 8 shows an alternative embodiment 122 of the invention whereby the elongate members 54, 64 are placed in a different location within shroud 139 of module 122. In accordance with the invention, elongate members are placed within the pin array of modules having power contact members only. It is to be recognized that the elongate members will protect inadvertent access only to those pin contact members that are essentially adjacent to the elongate members. For purposes of illustrating the invention this pin array is shown as a six by four matrix arrangement of members. The number of elongate members necessary to provide sufficient guard means for power contact members can be determined from the geometric configuration of the contact members in the power module or connector. The dimensions of the elongate members are such that each one essentially replaces four contact members.

Figure 9:
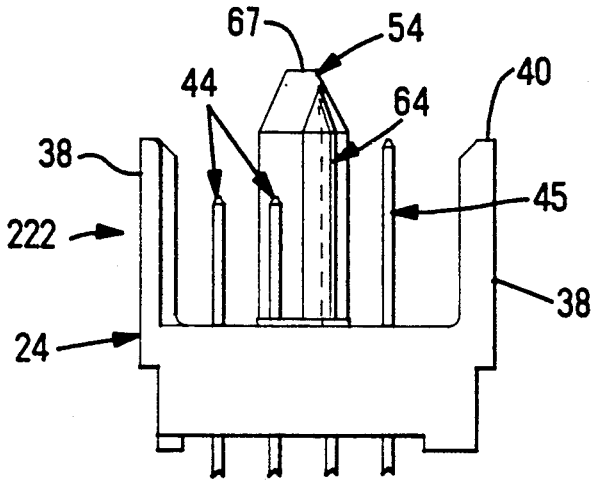
FIG. 9 illustrates an alternative embodiment of a module having a different array of contact members.

FIG. 9 shows a further alternative embodiment 222 of a connector module. In this embodiment, one row of contact members 45 is shown as extending to the leading edge 40 of the side wall 38 and comprise grounding means for the connector.

The present invention gives the advantage of having a pair of members that concomitantly provide aligning and safety features and that also permit keying of the mating connectors. In addition the members may also provide the means for mounting the connector to a board or backplane. These features are provided by members disposed within the pin array therefore eliminating the need for additional space on a board for providing the capabilities. The invention further provides flexibility for arranging various modules within a connector assembly.

It is thought that the connector assembly of the present invention and many of its attendant advantages will be understood from the foregoing description. Changes may be made in the form, construction and arrangement of parts thereof without departing from the spirit and scope of the invention or sacrificing all of its material advantages.

We claim:

1. An electrical connector having a dielectric housing including a transverse body section and a shroud portion extending forwardly therefrom to a leading edge, and further having an open array of pin contact members disposed in a plurality of rows and extending forwardly of said body section and within an open cavity defined by said shroud portion to respective leading ends recessed inwardly of said leading edge of said shroud portion, said open array of pin contact members being spaced from sidewalls of said shroud portion for mating with a complementary connector having a plurality of contact means complementary to said pin contact members and exposed for mating therewith at the mating face of said complementary connector, said connector further comprising at least one pair of closely spaced elongate members within said shroud portion, each of said elongate members being substantially surrounded by adjacent ones of said pin contact members of said open array, said elongate members being affixed only to said transverse body section between and isolated from said sidewalls of said shroud portion, enabling said elongate member to be disposed at selected locations in the midst of said open array and intermediate the ends of said open array of pin contact members, said elongate members being self-supporting and extending upwardly from said transverse body section to respective leading ends forwardly beyond said leading edge of said shroud portion, said elongate members being received within apertures of said complementary connector, said elongate members cooperating with said shroud portion and with each other to disallow inadvertent entry into said cavity proximate said recessed pin contacts adjacent said elongate members which would result in undesirable engagement with said adjacent pin contact members, whereby said pair of elongate members minimizes hazards from accidental contact with the adjacent pin contacts.

2. The connector of claim 1 further including at least one other pin contact member having a leading end that extends essentially to the leading edge of said shroud portion.

3. The connector according to claim 1 wherein at least one of said pair of elongate members is an alignment member cooperable with an alignment aperture of a complementary connector to align the connectors when they are mated.

4. The connector according to claim 3 wherein one of said at least one pair of said elongate members is an alignment member and the other of said at least one pair is a key member.

5. The connector according to claim 4 wherein said transverse body section includes identically configured seating apertures for receiving mounting portions of said alignment and keying members therein thereby enabling placement of said alignment and keying members in any one of said apertures, thereby increasing the number of possible keying positions for said connector.

6. The connector according to claim 1 wherein at least one of said pair of elongate members provides keying means for said connector when it is mated to a complementary connector.

7. The connector according to claim 6 wherein said transverse body section includes locating means for said pair of elongate members therein, said locating means assisting in the keying function whereby the location of said at least one keying member is interchangeable with that of the other elongate member, whereby said connector is adapted for customized assembly at a connector array of an apparatus.

8. A connector assembly comprising:

a receptacle member having a dielectric housing including a transverse body section and a shroud portion extending forwardly therefrom to a leading edge, and further having an open array of pin contact members disposed in a plurality of rows and extending forwardly of said body section and with an open cavity defined by said shroud portion to respective leading ends recessed inwardly of said leading edge of said shroud portion, said open array of contact members being spaced from sidewalls of said shroud portion for mating with a complementary connector having a plurality of contact means complementary to said pin contact members and exposed for mating therewith at the mating face of said complementary connector, said receptacle member further comprising at least one pair of closely spaced elongate members within said shroud portion, each of said elongate members being substantially surrounded by adjacent ones of said pin contact members of said open array, said elongate members being affixed only to said transverse body section enabling said elongate members to be disposed at selected location intermediate ends of said plurality of rows and in the midst of said open array of contact members and isolated from said sidewalls of said shroud portion, said elongate members being self-supporting and extending upwardly from said transverse body section to respective leading ends forwardly beyond said leading edge of said shroud portion, said elongate members being received within apertures of said complementary connector, said elongate members cooperating with said shroud portion and with each other to disallow inadvertent entry into said cavity of a foreign object otherwise able to enter the cavity proximate said recessed pin contacts adjacent said elongate members which would result in undesirable engagement with said adjacent pin contact members; and a complementary plug member having a dielectric housing including a corresponding array of complementary socket contact members for mating with said pin contact members of said receptacle and further including apertures for receiving said elongate members therein upon mating of said receptacle and plug members.

9. An electrical connector of the type having a mating face subjected to a safety test wherein a test probe having a minimum diameter of 0.25 inches is attempted to be inserted into said mating face for attempted engagement with any contact members therewithin, where any such engagement constitutes test failure, said connector comprising:

a dielectric housing including a transverse body section and a shroud portion extending forwardly therefrom to a leading edge;

an open array of pin contact members disposed in a plurality of rows and extending forwardly of said body section and within an open cavity defined by said shroud portion to respective leading ends recessed inwardly of said leading edge of said shroud portion, said open array of pin contact members being spaced from sidewalls of said shroud portion for mating with a complementary connector having a plurality of contact means complementary to said pin contact members and exposed for mating therewith at the mating force of said complementary connector; and at least one pair of closely spaced elongate members within said shroud portion, each of said elongate members being substantially surround by adjacent ones of said pin contact members of said open array, said elongate members being affixed only to said transverse body section enabling said elongate members to be disposed at selected locations intermediate ends of said plurality of rows and in the midst of said open array of contact members and isolated from said sidewalls of said shroud, said elongate members being self-supporting and extending upwardly from said transverse body section to respective leading ends forwardly beyond said leading edge of said shroud portion, said elongate members being adapted to be received within apertures of said complementary connector, said elongate members cooperating with said shroud portion and with each other to define constricted cavity portions surrounding said elongate members effectively shaped and dimensioned small enough to prevent entry of a said test probe into said cavity portions, and thereby preventing engagement between said probe and said leading ends of said contact members therewithin.

10. The connector of claim 9 further including at least one other pin contact member having a leading end that extends essentially to the leading edge of said shroud portion.

11. The connector according to claim 9 wherein at least one of said pair of elongate members is an alignment member cooperable with an alignment aperture of a complementary connector to align the corresponding pin contact and socket contact members within the connectors as the connectors are mated.

12. The connector according to claim 11 wherein one of said at least one pair of said elongate members is an alignment member and the other of said at least one pair is a key member.

13. The connector according to claim 12 wherein said transverse body section includes identically configured seating apertures for receiving mounting portions of said alignment and keying members therein thereby enabling placement of said alignment and keying members in any one of said aperture, thereby increasing the number of possible keying positions for said connector.

14. The connector according to claim 9 wherein at least one of said pair of elongate members provides keying means for said connector when it is mated to a complementary connector.

15. The connector according to claim 14 wherein said transverse body section includes location means for said pair of elongate members therein, said locating means assisting in the keying function whereby the location of said at least one keying member is interchangeable with that of the other elongate member, whereby said connector is adapted for customized assembly at a connector array of an apparatus.

* * * * *

UNITED STATES PATENT AND TRADEMARK OFFICE

CERTIFICATE OF CORRECTION

PATENT NO. : 5,173,063

DATED : December 22, 1992

INVENTOR(S) : Lee A. Barkus et al.

It is certified that error appears in the above-indentified patent and that said Letters Patent is hereby corrected as shown below:

Claim 9, Column 8, Line 55 - The word "force" should be --face--.

Claim 9, Column 8, Line 59 - The word "surround" should be --surrounded--.

Signed and Sealed this

Twenty-ninth Day of March, 1994

Bruce Lehman

*Attest:*

BRUCE LEHMAN

*Attesting Officer*

*Commissioner of Patents and Trademarks*